US006222399B1

(12) United States Patent
Imbornone et al.

(10) Patent No.: US 6,222,399 B1
(45) Date of Patent: Apr. 24, 2001

(54) BANDGAP START-UP CIRCUIT

(75) Inventors: James Imbornone, Methuen; Jean-Marc Mourant, Groton, both of MA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/450,567

(22) Filed: Nov. 30, 1999

(51) Int. Cl.[7] ..... G05F 1/10
(52) U.S. Cl. ..... 327/143; 327/539
(58) Field of Search ..... 327/142, 143, 327/198, 539, 540, 541, 543

(56) References Cited

U.S. PATENT DOCUMENTS

| | | | |
|---|---|---|---|
| 5,367,249 | 11/1994 | Honnigford | 323/313 |
| 5,453,679 | 9/1995 | Rapp | 323/313 |
| 5,747,978 | 5/1998 | Gariboldi et al. | 323/313 |
| 5,852,376 | 12/1998 | Kraus | 327/143 |
| 5,867,013 * | 2/1999 | Yu | 327/539 |
| 6,091,287 * | 2/1999 | Salter et al. | 327/539 |

OTHER PUBLICATIONS

A. Paul Brokaw, "A Temperature Sensor With Single Resistor Set–Point Programming," IEEE Journal of Soli–State Circuits, vol. 31, No. 12, 1908, 1915 (Dec. 1996).

* cited by examiner

*Primary Examiner*—Jung Ho Kim
(74) *Attorney, Agent, or Firm*—Ratner & Prestia; Harold Humberfeld, Esq.

(57) ABSTRACT

A circuit and a method for starting a bandgap circuit which is in a "non-start" mode. The circuit incorporates an inverter circuit with hysterysis and sharp transitions caused by a positive feedback loop. The inverter circuit, which is connected at its input to a bandgap voltage node of the bandgap circuit, activates a switching transistor when voltage (Vbg) at the bandgap voltage node is low and deactivates the switching transistor when Vbg is high. The switching transistor draws current from a critical node of the bandgap circuit, such as the drain of a current mirror PMOS transistor, when it is activated, starting the bandgap circuit.

15 Claims, 7 Drawing Sheets

BANDGAP START-UP CIRCUIT

TECHNICAL FIELD

The present invention relates generally to integrated circuits and, more specifically, to a device and method for starting a bandgap circuit that is in a "non-start" mode.

BACKGROUND OF THE INVENTION

In bipolar and bipolar complementary-metal-oxide-semiconductor (BiCMOS) circuit design, bandgap circuits are the method of choice to develop a stable voltage reference (e.g., voltage regulators incorporate a bandgap voltage reference) and to provide a bias current that is proportional to absolute temperature (PTAT). Both voltage regulators and PTAT current sources are widely used to bias analog circuits. Because the bandgap is fundamental to the biasing of any BiCMOS/Bipolar circuit, it is imperative that the bandgap circuit operate reliably. Failure of a bandgap circuit (e.g., a non-starter) can cause catastrophic failure of the integrated circuit.

Like other self-biasing circuits, bandgap circuits have two stable states: (1) normal operation (e.g., as designed), and (2) zero current, otherwise known as a "non-starter." Under normal operation, the bandgap circuit biases the rest of the integrated circuit ("IC") properly. In the non-starter state, however, the current is zero in each of the branches of the bandgap circuit. The bandgap circuit output (Vbg), which should be approximately 1.2 volts (the bandgap of silicon), remains close to zero (approximately 0.4 volts). In a non-starter bandgap circuit, the voltage regulators and PTAT current mirrors that depend on an accurate bandgap voltage are non-functional. Because an accurate bandgap voltage is necessary to the biasing of every BiCMOS/Bipolar circuit, a non-starter bandgap circuit renders the entire IC useless.

Several methods of starting a bandgap circuit, which is in a "non-start" mode either at initial start-up or due to a glitch such as a sudden interruption of power or a surge of power, are known in the art. In one of these methods, the power supply is snapped on quickly such that parasitic capacitance to ground at the drain of a p-type metal-oxide semiconductor ("PMOS") device in a current mirror holds that voltage low for a long enough period of time to start the current mirror, thereby starting the bandgap circuit. This method does not work if the power is brought up gradually from zero volts to Vcc.

Another method for starting bandgap circuits known in the art is to rely on the inherent leakage currents that exist in a PMOS transistor to maintain current mirror operation after a glitch. This method suffers from two major drawbacks. First, the recovery time after the glitch is slow due to the low levels of leakage current (i.e., on the order of microseconds). Second, the leakage currents which this method relies upon are highly dependant on the fabrication process and operating temperature, causing serious start-up reliability concerns.

Yet another method for starting bandgap circuits is to place a large value resistor from a critical node in the bandgap circuit to ground. This method suffers from three major problems. First, the intentional leakage path created by the resistor draws additional current, even when the bandgap circuit is operational. Second, the current must be leaked equally with respect to current mirrors to prevent an imbalance in biasing. Third, the very large value resistor required to implement this method is difficult to realize monolithically.

The importance of overcoming the various deficiencies noted above is evidenced by the extensive technological development directed to the subject, as documented by the relevant patent and technical literature. The closest and apparently more relevant technical developments in the patent literature can be gleaned by considering the following United States patents and technical literature.

U.S. Pat. No. 5,453,679 (issued to Rapp) shows a bandgap constant voltage circuit with a start-up circuit using a P-channel transistor and an N-channel transistor to form an inverter which switches on another N-channel transistor, causing the latter N-channel transistor to pull current through a P-channel transistor in a current mirror in the bandgap circuit when an Nref node in the bandgap circuit is low due to a non-start condition. The current pulled through the P-channel transistor starts the bandgap circuit. Although this patent provides hysterysis in the start-up circuit to mimimize oscillation, it does so by delaying transition at the inverter output. The start-up circuit disclosed in this patent does not provide sharp transitions (i.e., short switching time) and, therefore, requires a long period of time to start a bandgap circuit. This start-up circuit does not disclose or claim transition voltages and the difference between them. Also, the start-up circuit of the '679 patent requires eight transistors, a requirement that can adversely affect cost and reliability.

U.S. Pat. No. 5,852,376 (issued to Kraus) shows a power-on detect circuit. The circuit uses an inverter to suppress a bandgap signal to a differential amplifier until the bandgap reference voltage is stable.

U.S. Pat. No. 5,747,978 (issued to Gariboldi et al.) teaches a circuit for generating a reference voltage and detecting an under-voltage using a voltage divider (which can comprise resistors in series). The voltage divider provides an input to a comparator (which can comprise a bandgap circuit). The circuit further comprises a feedback network connected between the output of the comparator and a second input. For low supply voltages, the feedback loop is open and the voltage divider provides a voltage proportional to the supply voltage at the comparator input. As the voltage exceeds the threshold voltage (bandgap), the feedback loop holds the comparator input voltage at bandgap voltage. This circuit will always draw current, and therefore consume power when the bandgap circuit is operational. In addition, the '978 patent does not disclose or claim recovery time following a glitch.

U.S. Pat. No. 5,367,249 (issued to Honnigford) shows start-up circuitry for a bandgap reference circuit for initial power-up. The circuitry uses a power divider formed by two transistors to switch on a transistor coupled to a branch of the bandgap circuit, pulling current and starting the bandgap circuit. The start-up circuit disclosed in the '249 patent does not have a feedback loop providing hysterysis and sharp transitions.

A. Paul Brokaw, "A Temperature Sensor With Single Resistor Set-Point Programming," IEEE Journal of Solid-State Circuits, Vol. 31, No. 12, pages 1908, 1915 (December 1996), teaches a set-point temperature switching circuit using an hysterytic feedback loop with bipolar transistors.

The deficiencies of the conventional circuitry and methods for starting a bandgap circuit show that a need still exists for improvement. To overcome the shortcomings of the conventional circuitry, a new circuitry and method for starting a bandgap circuit is provided. It is an object of the present invention to provide circuitry and a method for starting a bandgap circuit during initial power-up or following a power glitch. It is another object of the present invention to provide an hysterytic circuit and a method for starting a bandgap circuit such that oscillation about the inverter transition voltage is prevented. It is a further object of the present invention to provide a circuit and method for starting a bandgap circuit which will restore bandgap operation in less than one microsecond using an inverter with a feedback loop to accelerate switching.

SUMMARY OF THE INVENTION

To achieve these and other objectives, and in view of its purposes, the present invention provides a circuit and method for starting a bandgap circuit which is in a "non-start" mode. The circuitry of the present invention incorporates an inverter circuit with hysterysis and sharp transitions caused by a positive feedback loop. The inverter circuit, which is connected at its input to a bandgap voltage node of the bandgap circuit, activates a switching transistor when voltage (Vbg) at the bandgap voltage node is low and deactivates the switching transistor when Vbg is high. The switching transistor draws current from a critical node of the bandgap circuit, such as the drain of a current mirror PMOS transistor, when the switching transistor is activated, starting the bandgap circuit.

The inverter circuit comprises a PMOS transistor and an NMOS transistor connected in series between POWER and GROUND. The inverter input is connected to the gate of the NMOS transistor and the inverter output is connected to the drain of the PMOS transistor and the drain of the NMOS transistor, as is known in the art. The inverter circuit of the present invention further comprises a positive feedback loop, however, consisting of a second NMOS transistor connected at its gate to the output node of the inverter circuit, connected at its drain to POWER through a second resistor, and connected at its source to the source of the NMOS transistor. The input of the inverter circuit is connected to the gate of the first NMOS transistor through a first resistor, and the source of the NMOS transistor is connected to GROUND through a third resistor.

As the input voltage of the inverter circuit goes from high to low and output voltage of the inverter circuit switches from low to high (e.g., a non-start mode following a power glitch), the second NMOS transistor is switched "off," removing current from the third resistor, reducing the first transition voltage of the inverter, and accelerating the switching of the inverter output voltage. As the input voltage of the inverter circuitry goes from low to high and the output voltage of the inverter circuitry switches from high to low (e.g., bandgap circuit start-up or recovery), the second NMOS transistor is switched "on," injecting additional current into the third resistor and further biasing the first NMOS transistor, thereby increasing the second transition voltage of the inverter and accelerating the switching of the inverter output voltage.

The present invention provides considerable improvement over the prior art. Because the second transition voltage is greater than the first transition voltage by at least 0.2 volts in the present invention, oscillation about the transition voltage by the bandgap start-up circuitry is prevented. Also, because the positive feedback loop of the inverter circuit provides accelerated switching of the inverter output voltage, and therefore the switching transistor, the bandgap start-up circuit of the present invention can provide very fast recovery times of less than one microsecond.

It is to be understood that both the foregoing general description and the following detailed description are exemplary, but are not restrictive, of the invention.

BRIEF DESCRIPTION OF THE DRAWING

The features and advantages of a circuit and method for starting a bandgap circuit according to the present invention and further details of a process of fabricating a semiconductor device in accordance with the present invention will be more clearly understood from the following description when read in connection with the accompanying drawing. Included in the drawing are the following figures.

DETAILED DESCRIPTION OF THE INVENTION

The present invention will be described in detail with reference to the accompanying drawing in which like reference numbers designate similar or corresponding elements, regions, and portions. The present invention provides a device (circuitry) and a method for starting a bandgap circuit which is in a non-start (no current) mode.

Structure of the Invention

Figure 1:
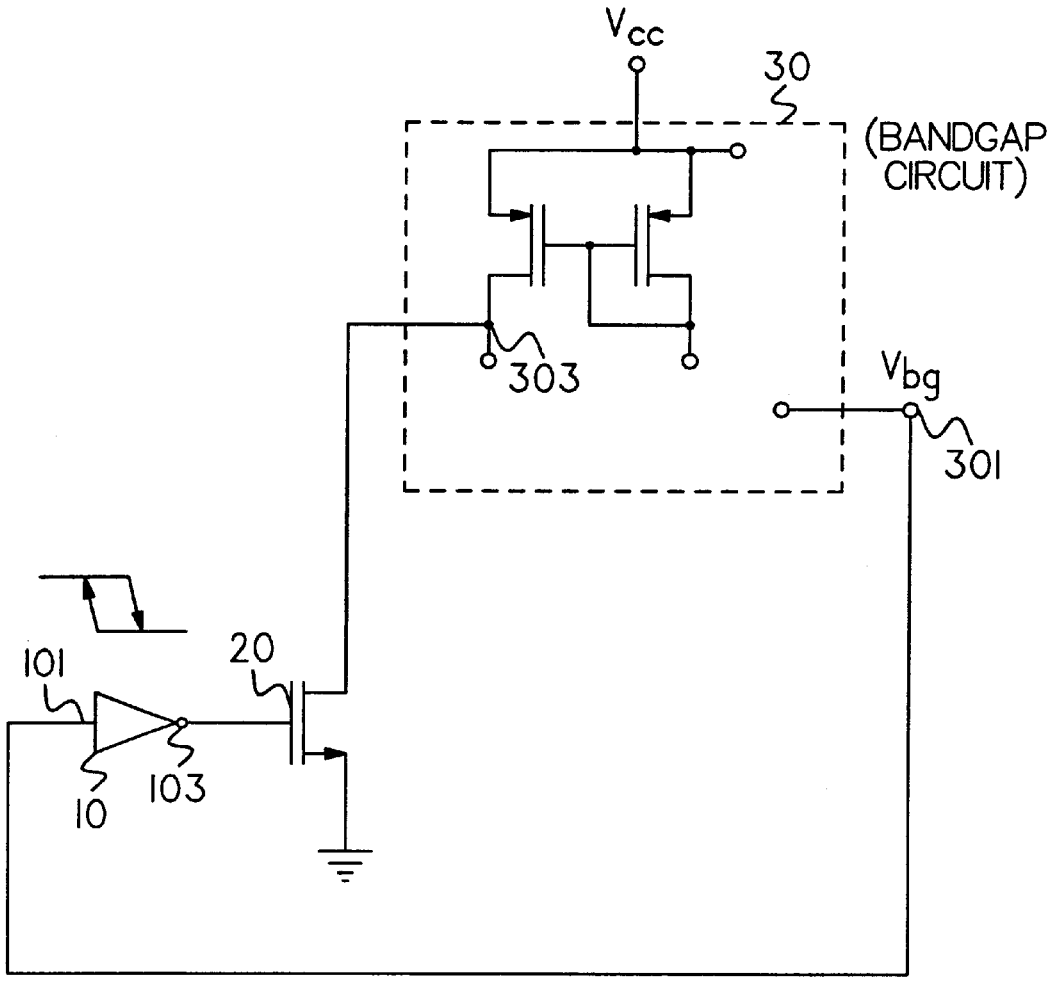
FIG. 1 illustrates a conceptual schematic of the present invention showing the inverter circuit, the switching transistor, the bandgap circuit, and their interconnections.

FIG. 1 shows a circuit diagram of the bandgap start-up circuit of the invention and the connections between the bandgap start-up circuit and a bandgap circuit (30). The bandgap start-up circuit comprises an inverter circuit (10) with hysterysis and a switching transistor (20). The inverter circuit (10) is connected at its input node (101) to a bandgap voltage output node (301) of the bandgap circuit (30). The voltage (Vbg) at the bandgap voltage output node (301) will be about 1.2 volts (the bandgap of silicon) during normal operation. During a non-start scenario, the voltage (Vbg) at the bandgap voltage output node (301) will be about 0.4 volts. The inverter circuit (10) has an OUTPUT node (103).

A key advantage of the inverter circuit (10) of the present invention is that it has hysterysis as indicated in FIG. 1. The hysterysis is caused by a positive feedback loop and provides transition voltages that are separated by at least 0.2 volts. A second key advantage provided by the positive feedback loop of the inverter circuit (10) is that switching (activation, deactivation) is accelerated, providing fast recovery time for the bandgap circuit (30). The present invention provides bandgap circuit recovery times of less than one microsecond.

Still referring to FIG. 1, the output of the inverter circuit (10) is connected to the input of the switching transistor (20). The switching transistor (20) is preferably an NMOS transistor which is connected to a critical node (303) of the bandgap circuit (30) at its drain and connected to ground at its source. The critical node (303) of the bandgap circuit (30) is a node where a current draw will restore the bandgap circuit (30) to normal operation, such as the drain of a current mirror PMOS transistor.

Figure 2:
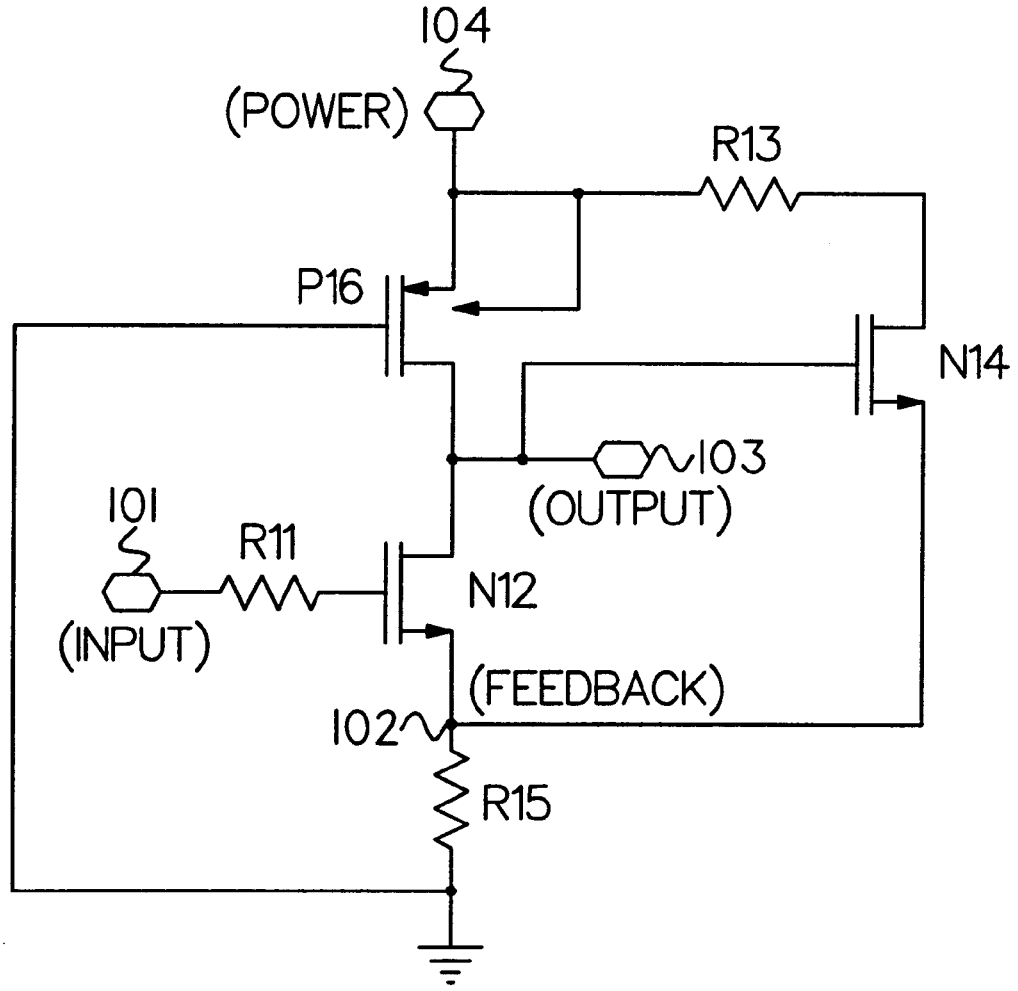
FIG. 2 illustrates a detailed schematic of the inverter circuit with a positive hysterytic feedback loop according to the present invention.

FIG. 2 illustrates a detailed schematic of the inverter circuit (10). The input node (101) of the inverter circuit (10) is connected through a first resistor (R11) to the gate of a first NMOS transistor (N12). The first resistor (R11) has a resistance about 2,000 ohms. The first NMOS transistor (N12) is connected at its drain to the OUTPUT node (103). At its source, the first inverter transistor is connected to a FEEDBACK node (102).

A first PMOS transistor (P16) is connected at its gate to ground; at its drain to the OUTPUT node (103); and at its drain and body to an internal power source (Vcc) at a POWER node (104). The first PMOS transistor (P16) and the first NMOS transistor (N12) invert the voltage at the INPUT node (101), providing the inverted voltage signal at the OUTPUT node (103). Thus, when the INPUT node (101) is at a high voltage, above the transition voltage, the OUTPUT node (103) is at a low voltage. The threshold of this inverter is lowered by increasing the gate length of the first PMOS transistor (P16) and therefore increasing its output impedence. The gate length of the first PMOS transistor (P16) in the embodiment is 20 $\mu$m. The first PMOS transistor (P16) and the first NMOS transistor (N12) are sized to provide a transition voltage between the non-start state (about 0.4 volts) and the normal operating state (about 1.2 volts), where the transition voltage (i.e., threshold voltage) is determined by the ratio of the output resistance of the first PMOS transistor (P16) to the output resistance of the first NMOS transistor (N12).

A second NMOS transistor (N14) is connected at its gate to the OUTPUT node (103); connected at its drain, through a second resistor (R13), to the POWER node (104); and connected at its source to the FEEDBACK node (102). The second resistor (R13) preferably has a resistance of about 1,000 ohms. The FEEDBACK node (102) is connected to ground through a third resistor (R15). A target of about 200 ohms is suitable for the third resistor (R15).

Operation of the Invention

When the bandgap circuit (30) is in a non-start mode, all branches of the bandgap circuit (30) have a zero current and the output voltage (Vbg) of the bandgap circuit (30) and, therefore, the INPUT node (101) of the inverter circuit (10) is low, about 0.4 volts. The voltage, which is below the first transition voltage of the inverter circuit (10), deactivates, or turns off, the first NMOS transistor (N12). As current stops flowing through the first NMOS transistor (N12), the OUTPUT node (103) swings to a high voltage. The increased voltage at the OUTPUT node (103) activates, or turns on, the second NMOS transistor (N14), injecting additional current into the third resistor (R15). The additional current through the third resistor (R15) further biases the first NMOS transistor (N12), accelerating the transition of the voltage at the OUTPUT node (103) from low to high and providing hysterysis reducing the first transition voltage.

As the voltage at the INPUT node (101) goes from low to high, the first NMOS transistor (N12) is activated, or turned on, and current is drawn from the OUTPUT node (103) through the first NMOS transistor (N12). As the current pulls the voltage at the OUTPUT node (103) low, the second NMOS transistor (N14) is deactivated, or turned off, thereby removing current from the third resistor (R15) and accelerating the transition of the voltage at the OUTPUT node (103) from high to low and providing hysterysis increasing the second transition voltage.

Figure 3:
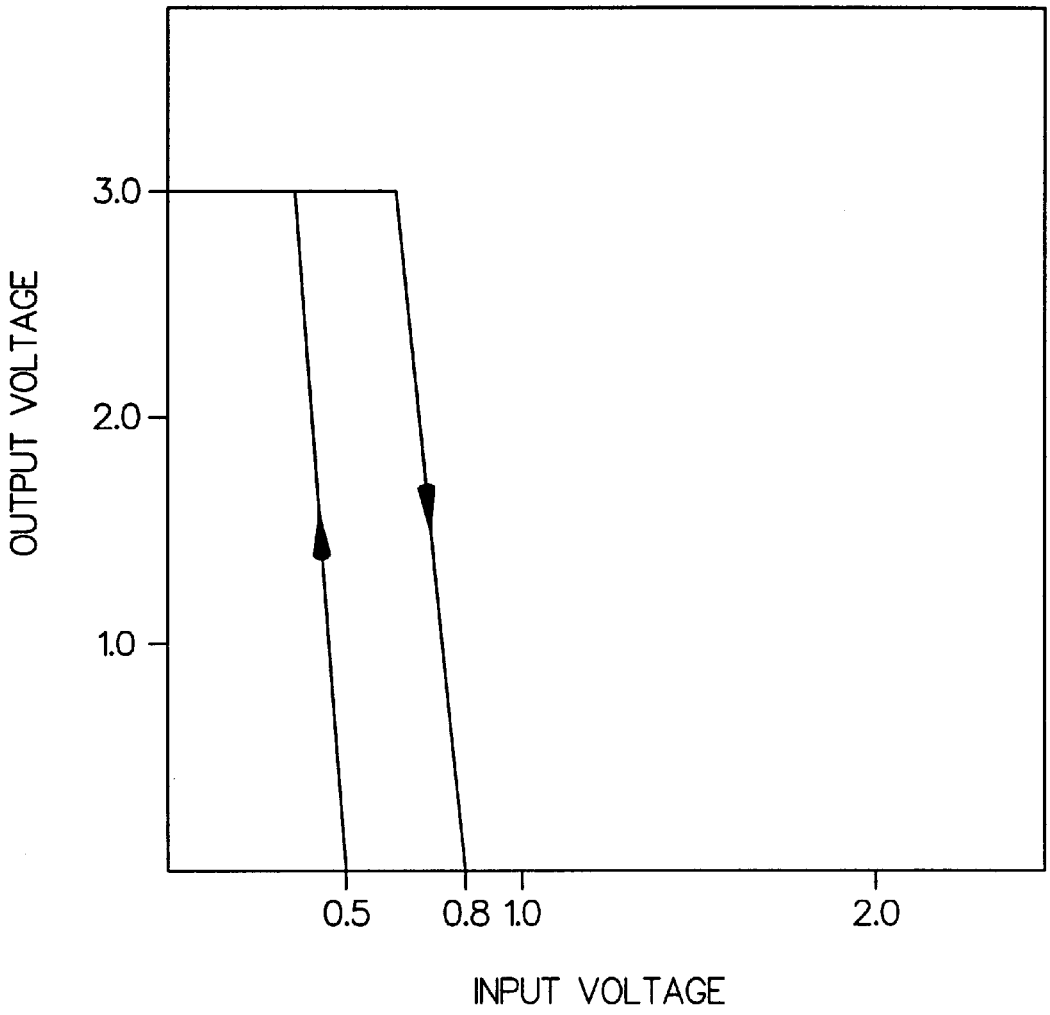
FIG. 3 illustrates the output voltage curve for the inverter circuit with a positive hysterytic feedback loop as a function of input voltage.

FIG. 3 shows the hysterytic voltage curve of the inverter circuit (10) of the present invention. The horizontal axis (abscissa) represents INPUT voltage and the vertical axis (ordinate) represents OUTPUT voltage. The first transition voltage, for which the INPUT voltage goes from high to low and the OUTPUT voltage goes from low to high, is at a voltage of about 0.5 volts. The second transition voltage, for which the INPUT voltage goes from low to high and the OUTPUT voltage goes from high to low, is at a voltage of about 0.8 volts.

Experimentation

Figure 4:
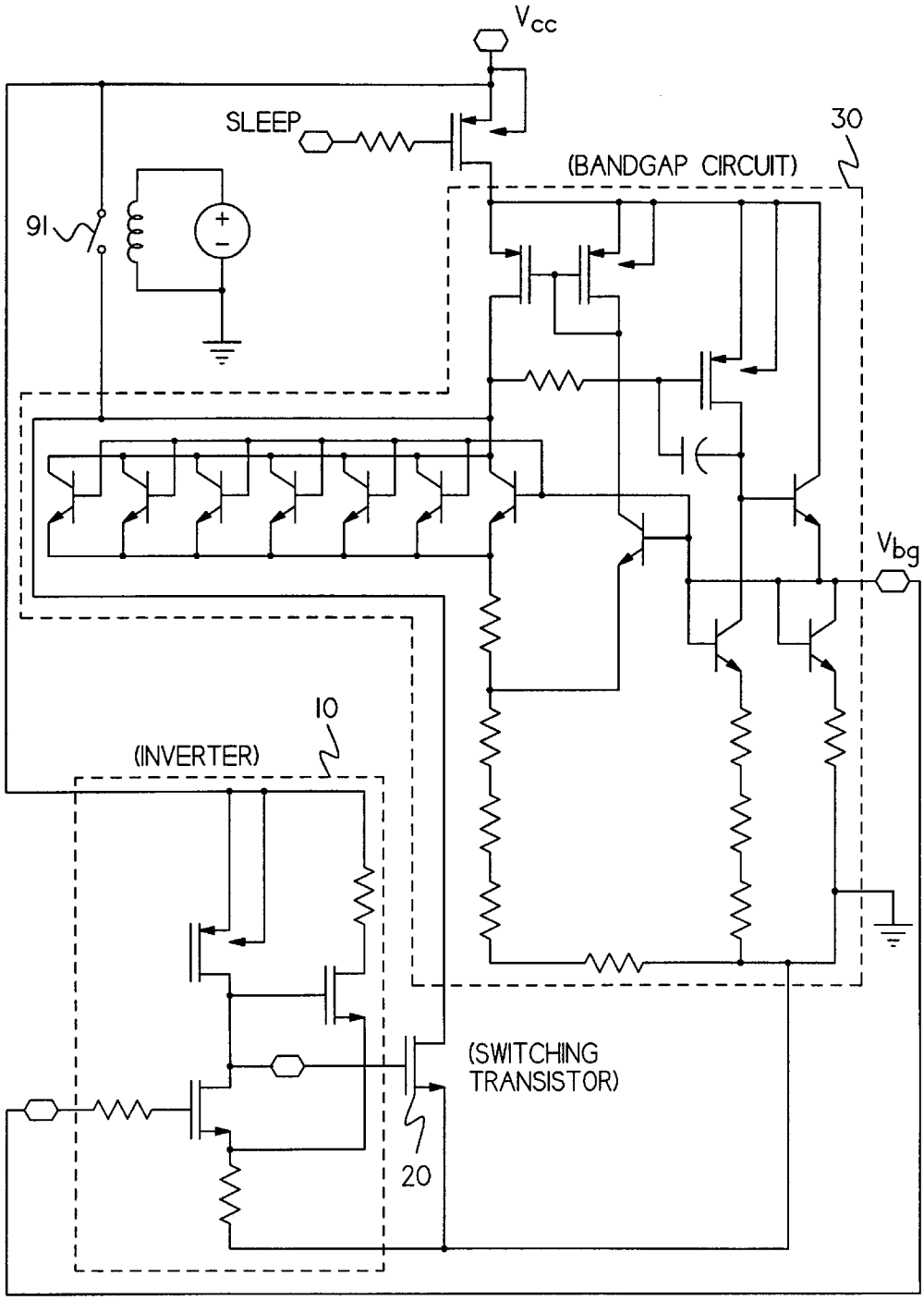
FIG. 4 illustrates a test set-up used to simulate a glitch and measure recovery time for a bandgap circuit.

A test set-up was built, as shown in FIG. 4. A connection was provided between an internal power source (Vcc) and the critical node (303) of the bandgap circuit (30). A switch (91) was provided in the connection; the switch (91) was normally open and could be closed by an external signal. The bandgap start-up circuit was disconnected, and the switch (91) was closed to intentionally cause a power glitch in the bandgap circuit (30), then allowed to open.

Figure 5:
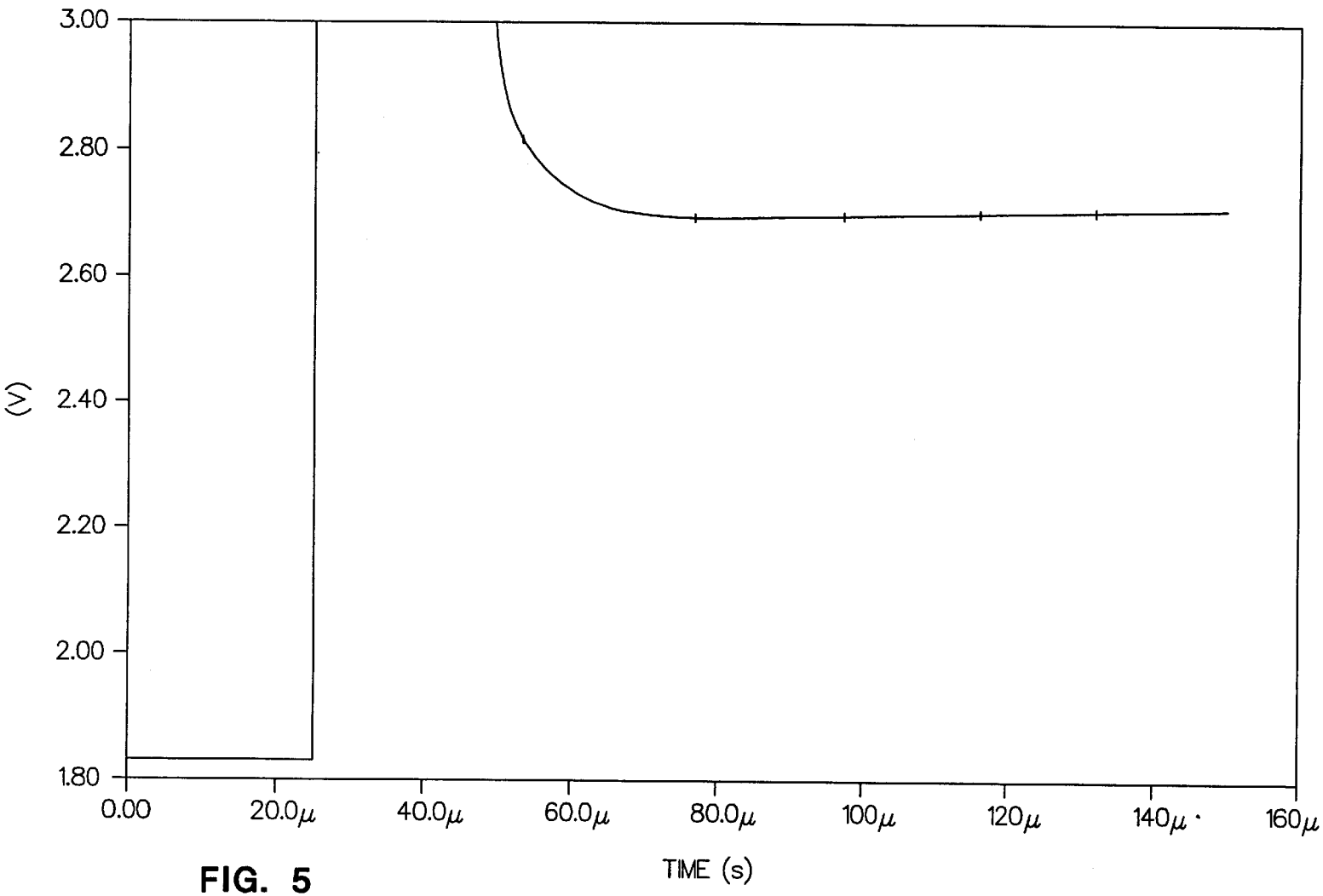
FIG. 5 illustrates the voltage curve at the test node of the bandgap circuit shown in FIG. 4, with the introduction of intentional glitching, without the bandgap start-up circuitry of the present invention connected.

FIG. 5 illustrates the voltage curve at the critical node (303) of the bandgap circuit (30) as a function of time with the bandgap start-up circuit disconnected. Thus, the voltage curve indicates the voltage at the critical node (303) after glitching the critical node (303) to Vcc. As shown in FIG. 5, the voltage at the critical node (303) of the bandgap circuit (30) hangs up at about the voltage of the internal power source (Vcc), even after the switch (91) is allowed to open, resulting in a non-start mode of the bandgap circuit.

Figure 6:
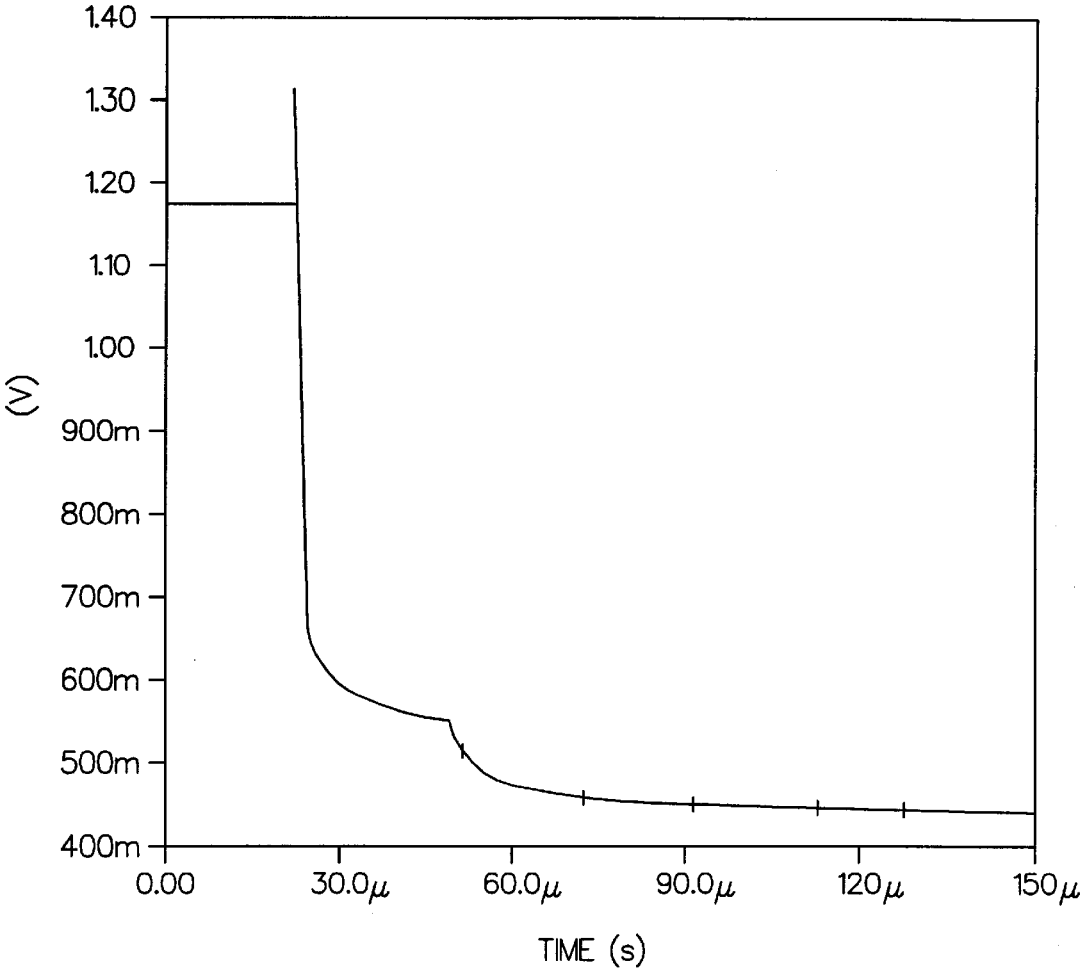
FIG. 6 illustrates the voltage curve at the output of the bandgap circuit shown in FIG. 4, with the introduction of intentional glitching, without the bandgap start-up circuitry of the present invention connected.

FIG. 6 illustrates the voltage curve at the bandgap voltage output node (301) of the bandgap circuit (30) as a function of time with the bandgap start-up circuit disconnected. Thus, the voltage curve indicates the voltage at the bandgap voltage output node (301) after glitching the critical node (303) to Vcc. The voltage at the bandgap voltage output node (301), as shown in FIG. 6, hangs up at about 0.4 volts, even after the switch (91) is allowed to open.

Figure 7:
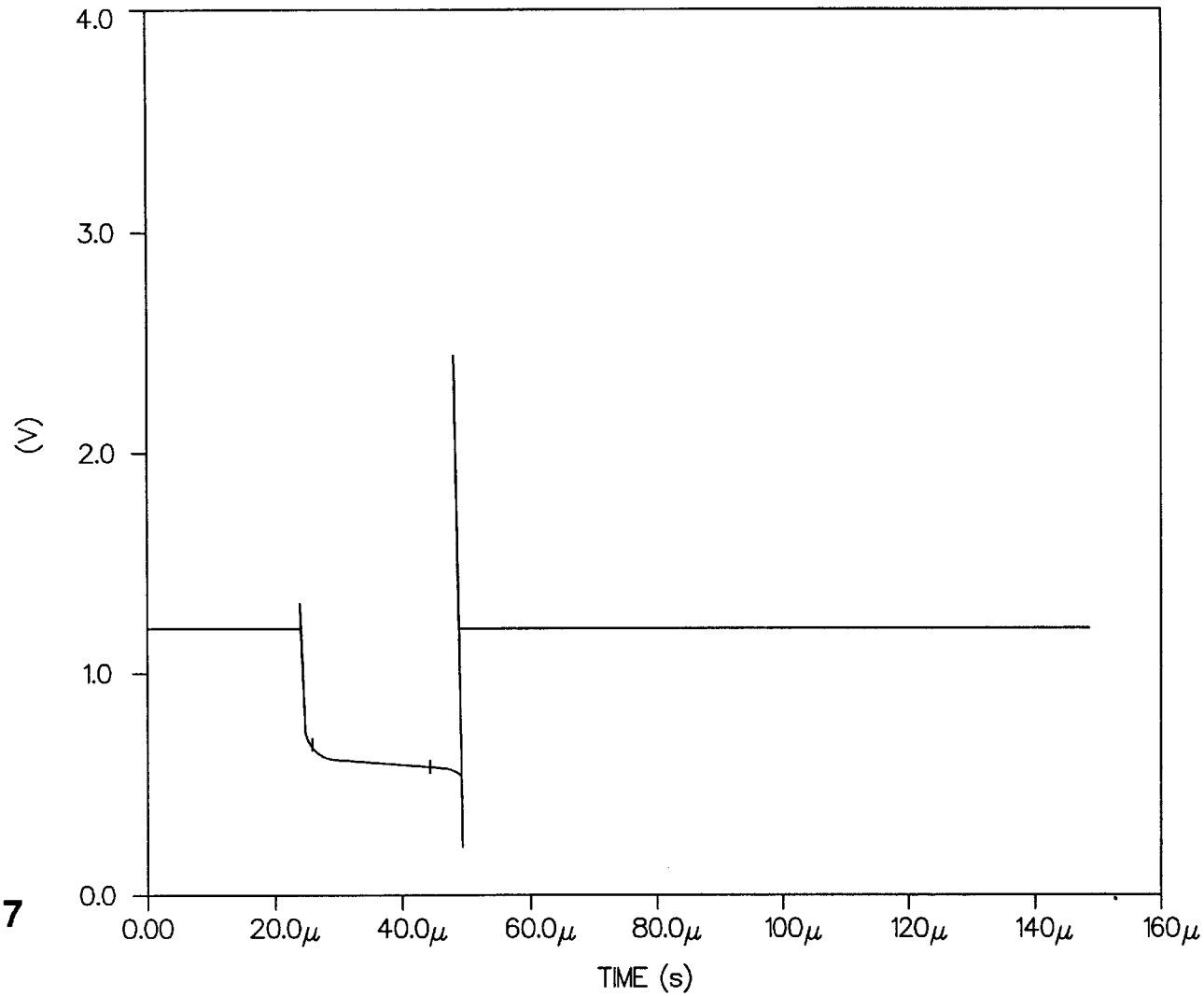
FIG. 7 illustrates the voltage curve at the output of the bandgap circuit shown in FIG. 4, with the introduction of intentional glitching, with the bandgap start-up circuitry of the present invention connected.

Next, the bandgap start-up circuit (10, 20) according to the present invention was connected to the test set-up, and the switch (91) was again closed to intentionally cause a power glitch in the bandgap circuit (30). The voltage at the bandgap voltage output node (301) was measured as a function of time with the bandgap start-up circuit connected, as shown in FIG. 7. The voltage at the bandgap voltage output node (301) of the bandgap circuit (30) drops to about 0.5 volts as the switch (91) is closed. However, with the bandgap start-up circuitry connected, as the switch is allowed to open at a time of about 50 microseconds, the voltage at the bandgap voltage output node (301) recovers to about 1.2 volts (the bandgap voltage of silicon) in less than 1 microsecond.

Although illustrated and described above with reference to certain specific embodiments, the present invention is nevertheless not intended to be limited to the details shown. Rather, various modifications may be made in details within the scope and range of equivalents of the claims and without departing from the spirit of the invention.

What is claimed is:

1. A bandgap start-up circuit, comprising:

a bandgap circuit having a bandgap voltage node and a critical node;

an inverter having a hysteretic feedback loop, an output node, and an input connected to the bandgap voltage node of the bandgap circuit; and an NMOS switching transistor having a gate connected to the output node of the inverter, a drain connected to the critical node of the bandgap circuit, and a source connected to ground;

whereby, when the voltage at the input of the inverter falls below a first transistion voltage, the output of the inverter switches high, switching on the NMOS switching transistor and drawing current through the critical node of the bandgap circuit causing the bandgap circuit to start normal operation, and when the voltage of the input of the inverter goes higher than a second transition voltage, the inverter output switches low, switching off the NMOS switching transistor such that no current is drawn from the critical node of the bandgap circuit.

2. The bandgap start-up circuit of claim 1 wherein the second transition voltage is more than 0.2 volts greater than the first transition voltage.

3. The bandgap start-up circuit of claim 1 wherein the first transition voltage is between about 0.4 V and 0.6 V, and the second transition voltage is between about 0.7 V and 0.9 V.

4. The bandgap start-up circuit of claim 1 wherein the bandgap circuit resumes normal operation in less than 1 microsecond.

5. The bandgap start-up circuit of claim 1 wherein the NMOS switching transistor source is connected to the drain of a PMOS transistor in a current mirror.

6. A bandgap start-up circuit, comprising:

a bandgap circuit having a BANDGAP VOLTAGE node and a critical node;

an NMOS switching transistor having a source connected to the critical node of the bandgap circuit, a gate, and a drain connected to GROUND; and an inverter circuit having a hysteretic feedback loop including:

(a) an INPUT node connected to the BANDGAP VOLTAGE node of the bandgap circuit, (b) an OUTPUT node connected to the gate of the NMOS switching transistor, (c) a FEEDBACK node, (d) a first resistor having a first end connected to the INPUT node and a second end, (e) a second resistor having a first end connected to POWER and a second end, (f) a third resistor connected at its first end to GROUND, (g) a first NMOS transistor having a gate connected to the second end of the first resistor, a drain connected to the OUTPUT node, and a source connected to the FEEDBACK node;

(h) a second NMOS transistor having a gate connected to the OUTPUT node, a drain connected to the second end of the second resistor, and a source connected to the FEEDBACK node, and (i) a first PMOS transistor having a gate connected to GROUND, a source and a body connected to POWER, and a drain connected to the OUTPUT node.

7. The bandgap start-up circuit of claim 6 wherein normal operation of the bandgap circuit is started in less than 1 microsecond.

8. The bandgap start-up circuit of claim 6 wherein the inverter circuit has a first transistion voltage of between about 0.4 volts and 0.6 volts when the input voltage goes from a high state to a low state, and a second transition voltage of between about 0.7 volts and 0.9 volts when the input voltage goes from a low state to a high state.

9. The bandgap circuit of claim 8 wherein the second transition voltage is at least 0.2 volts greater than the first transition voltage.

10. The bandgap start-up circuit of claim 6 wherein the NMOS switching transistor is connected, at its source, to the drain of a PMOS transistor in a current mirror.

11. A method for starting a bandgap circuit, comprising the steps of:

providing a voltage signal from the output of a bandgap circuit to an inverter;

inverting the signal from the output of the bandgap circuit, using an inverter circuit having a positive feedback loop which has hysterysis and sharp transitions; and providing the inverted signal to a switching transistor; whereby if the voltage signal from the output of the bandgap circuit is low, the switching transistor is turned on, drawing current from a critical node of the bandgap circuit thereby starting the bandgap circuit, and if the voltage signal from the output of the bandgap circuit is high, the switching transistor is turned off, and no current is drawn from the critical node of the bandgap circuit through the switching transistor.

12. The method of claim 11 wherein the bandgap circuit is started in less than 1 microsecond.

13. The method of claim 11 wherein the inverter circuit has a first transistion voltage of between about 0.4 volts and 0.6 volts when the input voltage goes from a high state to a low state, and a second transition voltage of between about 0.7 volts and 0.9 volts when the input voltage goes from a low state to a high state.

14. The method of claim 13 wherein the second transition voltage is at least 0.2 volts greater than the first transition voltage.

15. The method of claim 11 wherein the critical node of the bandgap circuit is at the drain of a PMOS transistor in a current mirror.

* * * * *